US006003272A

United States Patent [19]

Resch

[11] Patent Number: 6,003,272

[45] Date of Patent: Dec. 21, 1999

[54] INSULATED EAVE STRUT MEMBER

[75] Inventor: Gerald F. Resch, Calgary, Canada

[73] Assignees: MGI Canada Inc., Winnipeg; Therm-All Industries (Western) 1982 Ltd., Calgary, both of Canada

[21] Appl. No.: 09/175,617

[22] Filed: Oct. 20, 1998

[51] Int. Cl.[6] ..... G04B 7/00

[52] U.S. Cl. ..... 52/94; 52/309.8; 52/169.14; 52/170; 52/737.4; 52/737.5

[58] Field of Search ..... 52/94, 309.8, 169.14, 52/170, 737.4, 737.5

*Primary Examiner*—Christopher T. Kent
*Assistant Examiner*—Nkeisha J. Maddox
*Attorney, Agent, or Firm*—Adrian D. Battison; Murray E. Thrift

[57] ABSTRACT

A steel building having a frame with at least one roof beam on respective top sides of the frame wherein the top ends of the roof beams defines an apex, at least one side wall post and an eave strut member along the outer edge of the roof at the side wall posts being generally square and tubular in construction, having a hollow interior, an open face in which flanges on respective sides are directed inwardly, being insulated by inserting an insertion means into the hollow interior and a barrier wrap around the strut member between each of the side posts. A kit of parts for the building comprising an insertion means at the inner portion and a barrier wrap surround the strut member between each of the side posts.

4 Claims, 2 Drawing Sheets

INSULATED EAVE STRUT MEMBER

The present invention relates to an insulated eave strut member on a steel building or the like.

BACKGROUND OF THE INVENTION

It is well known that steel buildings are manufactured with a steel frame structure which defines vertical posts at side walls of the building and roof beams spanning the posts which are generally arched to form an apex centrally of the roof structure. Across the roof beams is laid a plurality of parallel purlins. Across the post is attached a plurality of horizontal rails.

After the steel structure of the building is complete, and before the outside cladding is applied, insulation is applied to the walls and to the roof. The insulation for the walls is applied in vertical strips which are suspended from the top edge strip of the roof and extend downwardly across the wall rails. The strip is fastened to each rail. The strip is formed of an outside layer of insulation material such as fibreglass which carries an inside sheet of a finishing material which presents the inside surface of the building. The sheet can be formed of various materials including plastics, foil and others depending upon the required inside finished layer. Each strip has a portion of the sheet exposed along one side edge for overlapping the next strip and for fastening thereto by adhesive. In this way the sheet forms a continuous layer on the inside surface of the insulation material.

After the strips are applied the top eave rail creates a space in which is not completely insulated. Generally the space is ignored, the present invention provides a kit in which insulation is applied in the rail and then is wrapped with laminated wall insulation and taped with an adhesive were the wrapping meets. This process allows the building to be completely insulated.

SUMMARY OF THE INVENTION

According to one aspect of the invention there is provided a steel building comprising:

a frame;

at least one roof beam on respective top sides of the frame wherein the top ends of the roof beams defines an apex;

at least one side wall post;

and an eave strut member along the outer edge of the roof at the side wall posts being generally square and tubular in construction, having a hollow interior, an open face in which flanges on respective sides are directed inwardly, being insulated by inserting an elongate insulation material into the hollow interior and a barrier strip wrapped around the strut member between each of the side posts.

Preferably the eave strut member has a bottom wall is longer than that of a top wall such that a first flange on the bottom wall is positioned in an off set manner to a second flange on the top wall.

Preferably the elongate insulation material is placed into the hollow interior such that it fills the entire cavity;

the elongate insulation material being constructed from a plurality of fibreglass insulation strips incorporated to form an elongate block.

Preferably the barrier strip is of suitable width to wrap around the eave strut such that the strip is overlapped at a rear end and taped in position;

the tape having adhesive on each side;

the strip being of a suitable material to form a vapour barrier around the strut.

In another aspect of the present invention there is provided kit of parts for a building with a steel frame, the building comprising:

a frame;

at least one roof beam on respective top sides of the frame wherein the top ends of the roof beams defines an apex;

at least one side wall post;

and an eave strut member along the outer edge of the roof at the side wall posts being generally square and tubular in construction, having a hollow interior and an open face in which flanges on respective sides are directed inwardly;

the kit of parts comprising:

an elongate insulation material at the inner portion and a barrier strip to surround the strut member between each of the side posts.

Preferably a bottom wall of the eave strut is longer than that of a top wall of the eave strut such that a first flange on the bottom wall is positioned in an off set manner to a second flange on the top wall.

Preferably the elongate insulation material is placed into the hollow interior such that it fills the entire cavity;

the elongate insulation material being constructed from a plurality of fibreglass insulation strips incorporated to form an elongate block of insulation.

Preferably the barrier strip is of suitable width to wrap around the eave strut such that the strip is overlapped at a rear end and taped in position;

the tape having adhesive on each side;

the strip being of a suitable material to form a vapour barrier around the strut.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
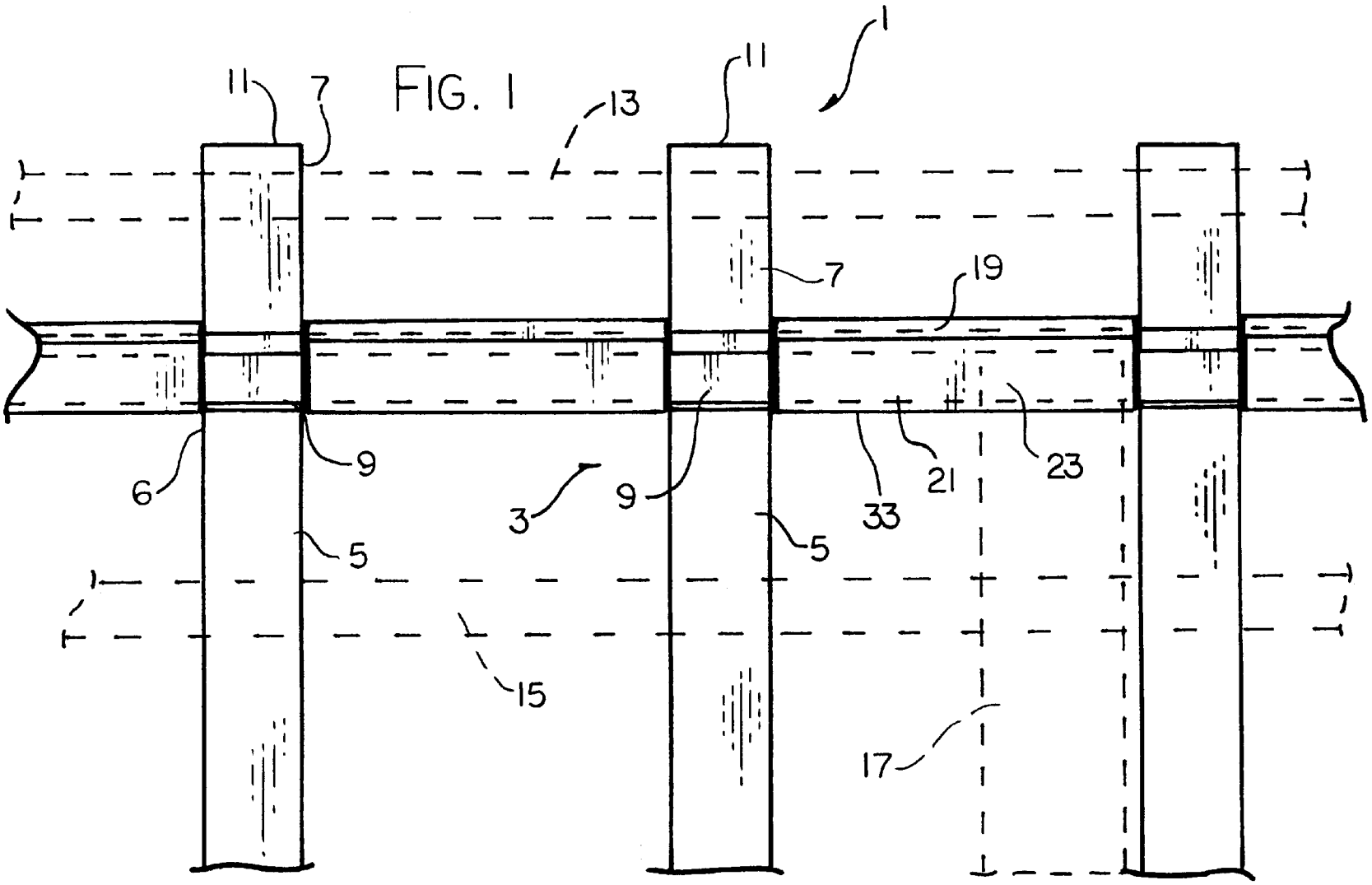
FIG. 1 is a side elevational view of a steel building with the insulated eave strut member.

A conventional steel building structure 1 is shown in FIG. 1 includes vertical side wall posts 5 arranged in parallel rows spaced equidistantly apart are attached at the upper 6 ends to roof beams 7 which span parallel and equidistantly spaced between the side wall posts on one side across to an apex 11 and to the side wall posts on the opposite side. Across the beams 7 of the roof is applied a plurality of purlins 13 which arranged at suitable spacing and at right angles to the beams. At the edge of the roof beams where it joins the post is provided a eave rail 9 which defines the edge of the roof at which is attached conventionally the guttering of the building. Across the posts 5 are attached rails 15 which are again parallel and at right angles to the posts and beams. In order to complete the structure of the building, strips of insulation material are applied to the rails 15, the strips are arranged side by side and in the drawings one such strip is shown indicated at 17 formed of a suitable material so that in the finished building to form a complete sheet acting as an inside surface and a vapour barrier.

Figure 2:
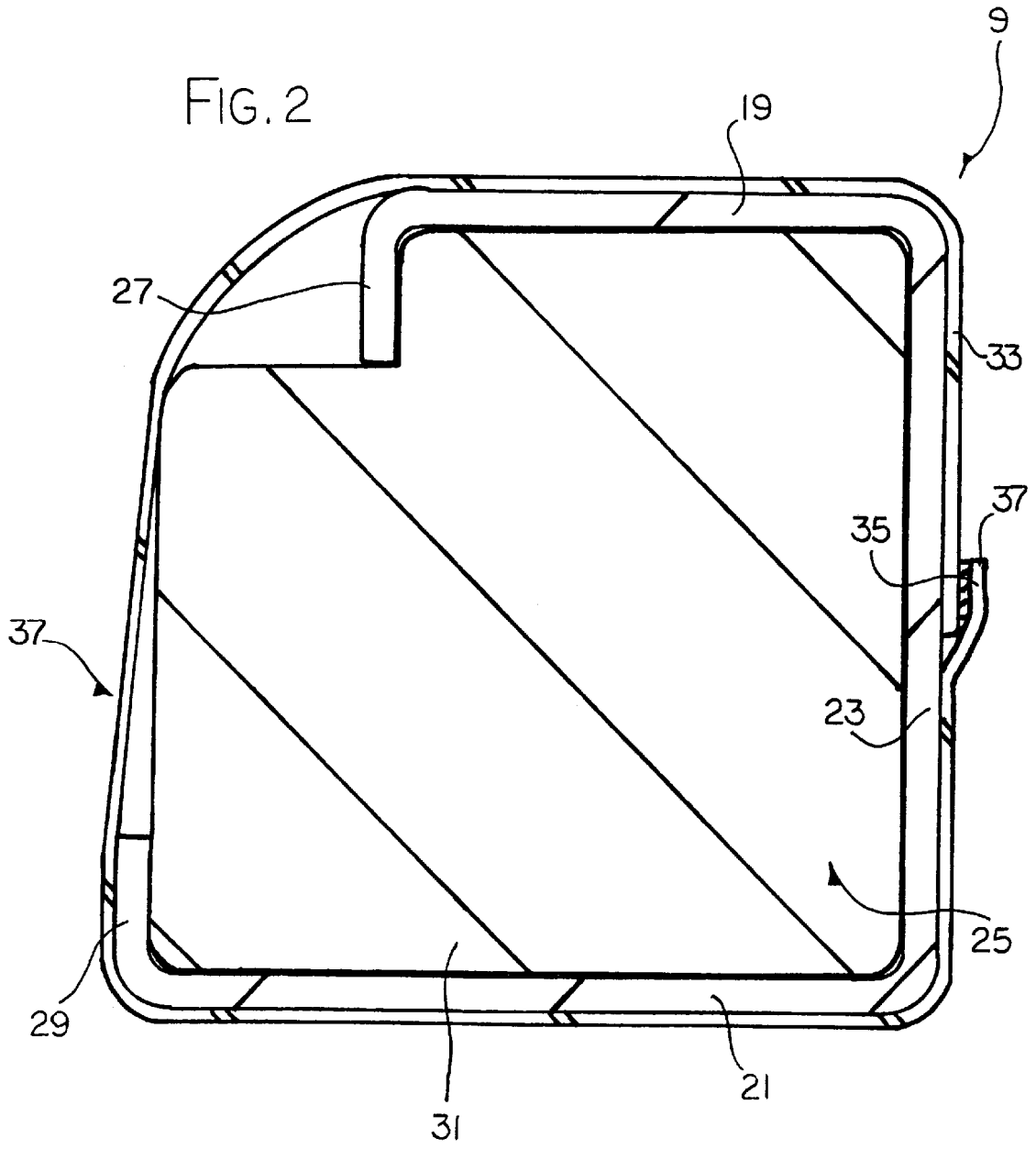
FIG. 2 is a vertical cross section along the lines 2—2 of FIG. 1.

The eave rail 9, as best shown in FIG. 2, is generally square and generally tubular in shape with a top edge 19, a bottom edge 21 and a rear edge 23. The rear edge 23 is arranged to be attached to the roof beams for support. A first flange 27 extends downwardly from the top edge 19 and a second flange 29 extends upwardly from the bottom edge 21 defining an opening 37. The bottom edge 21 is slightly longer in length that the top edge and is the same length as the rear edge such that the first flange is slightly off set rearwardly from the second flange.

An elongate insulation material 31, of suitable insulating material, is placed through the opening 37 into the hollow interior 25 of the eave rail such that it fills the entire cavity. The elongate insulation material 31 is of appropriate size such that the length reaches from one vertical post in the eave rail to the next vertical post. Preferably the insulation material is laminated fiber glass insulation shaped into a rectangular block having a cross-section generally matching that of the rail. The insulation material is compressible so that it can be inserted through the opening in the side of the rail and will then expand to fill the interior of the rail.

A barrier strip 33, being the same material as used for the strips 17, is wrapped around the eave rail from vertical post to vertical post creating a vapour barrier around the eave rail. The barrier wrap 33 is of suitable width as to wrap around the rail and is taped at the rear edge 23 with a suitable adhesive material 35 forming an overlapped portion 37. When the roof and walls are insulated the roof and wall vapour barriers are taped or caulked to the eave rail barrier wrap. The barrier material is vapor impermeable. It has an outside surface that is the surface visible within the building which can be entirely utilitarian in appearance or can be colored or coated to provide a required more attractive appearance. In any event, the exposed face is arranged to match the exposed face of the strips on the walls to provide an attractive appearance of the finished product.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

I claim:

1. A steel building comprising:

a frame;

at least one roof beam on respective top sides of the frame wherein the top ends of the roof beams defines an apex;

at least one side wall post;

and an eave strut member along the outer edge of the roof at the side wall posts being generally square and tubular in construction, having a hollow interior, an open face in which flanges on respective sides are directed inwardly, being insulated by inserting an elongate insulation material into the hollow interior and a barrier strip wrapped around the strut member between each of the side posts.

2. The steel building according to claim 1 wherein the eave strut member has a bottom wall is longer than that of a top wall such that a first flange on the bottom wall is positioned in an off set manner to a second flange on the top wall.

3. The steel building according to claim 1 wherein the elongate insulation material is placed into the hollow interior such that it fills the entire cavity;

the elongate insulation material being constructed from a plurality of fibreglass insulation strips incorporated to form an elongate block.

4. The steel building according to claim 1 wherein the barrier strip is of suitable width to wrap around the eave strut such that the strip is overlapped at a rear end and taped in position;

the tape having adhesive on each side;

the strip being of a suitable material to form a vapour barrier around the strut.

* * * * *